US007977612B2

(12) United States Patent
Levy et al.

(10) Patent No.: US 7,977,612 B2
(45) Date of Patent: Jul. 12, 2011

(54) CONTAINER FOR MICROWAVEABLE FOOD

(75) Inventors: Mariean Levy, Montvale, NJ (US); Marvin Levy, Montvale, NJ (US); Paul Lam, Hong Kong (HK)

(73) Assignee: Mariean Levy, Montvale, NJ (US)

( * ) Notice: Subject to any disclaimer, the term of this patent is extended or adjusted under 35 U.S.C. 154(b) by 0 days.

(21) Appl. No.: 12/012,403

(22) Filed: Feb. 2, 2008

(65) Prior Publication Data

US 2010/0282744 A1 Nov. 11, 2010

(51) Int. Cl.
*H05B 6/64* (2006.01)
*H05B 6/80* (2006.01)

(52) U.S. Cl. ..... 219/729; 219/682; 99/495

(58) Field of Classification Search ..... 219/682, 219/725–735, 762, 763, 401; 99/451, DIG. 14, 99/448

See application file for complete search history.

(56) References Cited

U.S. PATENT DOCUMENTS

| | | | | |
|---|---|---|---|---|
| 403,093 | A | 5/1889 | Dawes et al. | |
| 2,072,428 | A * | 3/1937 | Parise | 126/33 |
| 2,487,240 | A * | 11/1949 | Hildreth | 294/29 |
| 3,874,085 | A | 4/1975 | Atkins | |
| 4,871,892 | A * | 10/1989 | Samford | 219/733 |
| 4,955,513 | A * | 9/1990 | Bennett | 222/480 |
| 6,217,918 | B1 | 4/2001 | Oh et al. | |
| 6,730,895 | B2 * | 5/2004 | Kim | 219/682 |
| D508,371 | S * | 8/2005 | Campbell | D7/395 |
| 7,067,778 | B2 | 6/2006 | Kim | |
| 7,124,891 | B2 | 10/2006 | Kolar et al. | |
| 7,303,075 | B2 | 12/2007 | Herbert et al. | |
| 7,392,907 | B2 | 7/2008 | Herbert et al. | |
| 2003/0070559 | A1 * | 4/2003 | Victor | 99/417 |
| 2005/0173421 | A1 * | 8/2005 | Kim | 219/682 |
| 2006/0254948 | A1 | 11/2006 | Herbert et al. | |
| 2007/0131701 | A1 | 6/2007 | Herbert et al. | |

FOREIGN PATENT DOCUMENTS

| | | | |
|---|---|---|---|
| JP | 2004065342 | A * | 3/2004 |
| KR | 879531 | | 7/1987 |
| KR | 200336747 | | 12/2003 |
| KR | 1020040082095 | | 9/2004 |
| WO | WO 2005048789 | | 6/2005 |

OTHER PUBLICATIONS

English-language computer translation of Republic of Korea Publication No. 20-0336747, Dec. 10, 2003.

English-language abstract of Republic of Korea Publication No. 10-2004-0082095, Sep. 24, 2004.

International Search Report for International Application No. PCT/US2008/080874, Aug. 6, 2009.

* cited by examiner

*Primary Examiner* — Quang T Van

(74) *Attorney, Agent, or Firm* — Cooper & Dunham LLP

(57) ABSTRACT

A container for microwavable food has a main container part for accommodating a food product to be cooked and open from above, a cover covering the main container part from above, and at least one insert accommodated in the container part and provided with a plurality of perforations for placing a food product to be steamed on the insert.

5 Claims, 5 Drawing Sheets

CONTAINER FOR MICROWAVEABLE FOOD

BACKGROUND OF THE INVENTION

The present invention relates to containers for microwaveable food, in which the food can be cooked or heated up.

Containers for microwavable cooking are known and widely used. The containers are composed of various materials and usually include a main container part in which a food to be cooked is accommodated, and a cover which covers the main container part from above. Some covers are provided with openings allowing escape of evaporating liquid. It is believed that the existing containers can be further improved.

SUMMARY OF THE INVENTION

Accordingly, it is an object of the present invention to provide a container for microwavable food, which is a further improvement of the existing containers for microwavable food.

In keeping with these objects and with others which will become apparent hereinafter, one feature of the present invention resides, briefly stated, in a container for microwavable food, comprising a main container part for accommodating a food product to be cooked and open from above; a cover covering said main container part from above; and at least one insert accommodated in said container part and provided with a plurality of perforations for placing a food product on said insert.

Another feature of the present invention resides, briefly stated, in that the cover of the container is composed of two parts which are alternatingly liftable so as to open only one portion of the main container part, and configured so that one of said cover parts has a plurality of throughgoing holes, while another of said container parts is solid.

In accordance with another feature of the present invention, the container has at least one handle, and preferably two handles, each configured as a measuring element for measuring a product to be introduced into the container. The handles can be formed as hollow substantially cylindrical elements with a cylindrical central portion and at least one, preferably two funnels at the opposite ends of the cylindrical portion.

In the container in accordance with the present invention the insert provided with a plurality of perforations for steaming food product and allowing passage of vapors, can be placed either on a bottom of the main container part and centered by a centering portion, or in a top area of the main container part and centered on a shoulder provided on a peripheral wall of the container. It is possible that both such insert can be provided in the container in accordance with the present invention.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
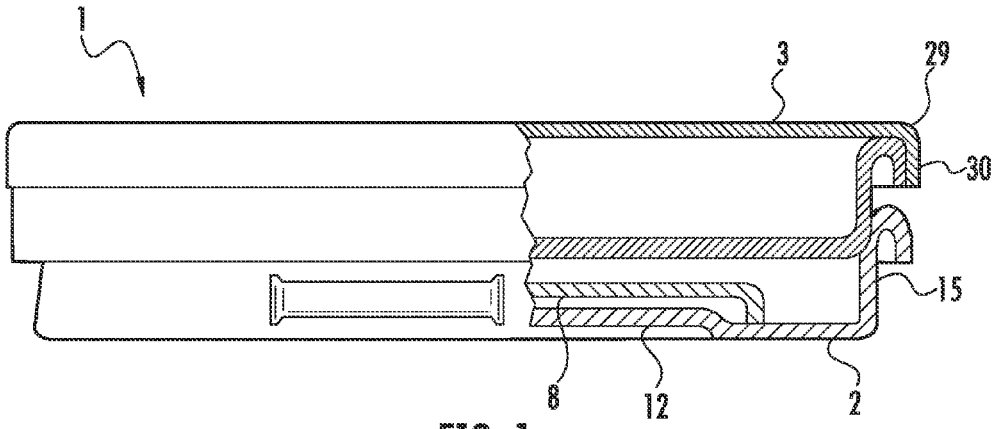
FIG. 1 is a side view of a container for microwavable food in accordance with the present invention with a partial section.
Figure 2:
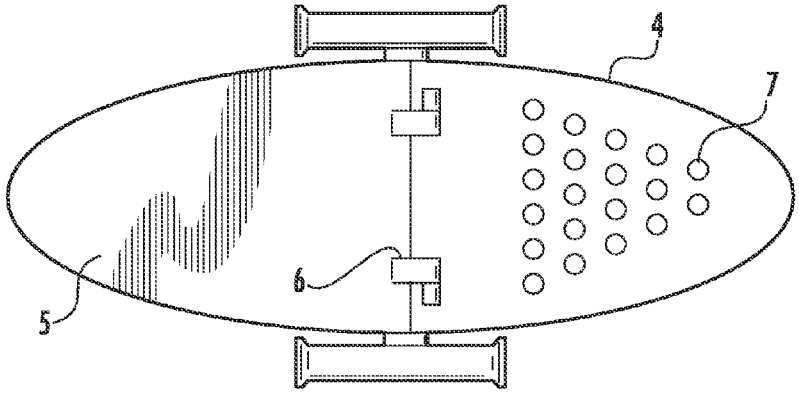
FIG. 2 is a plan view of the container for microwavable food in accordance with the present invention.
Figure 3:
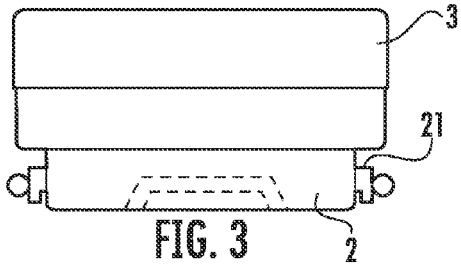
FIG. 3 is an end view of the container for microwavable food in accordance with the present invention.

A container for microwavable food in accordance with the present invention is identified as a whole with reference numeral 1. It can be composed of a suitable material, for example of a microwave-resistant plastic, etc.

The container has a main container part for accommodating a food to be cooked or heated up, which is identified with reference numeral 2. The container further has a cover for covering the main container part from above and identified with reference numeral 3, as shown in FIG. 1.

The cover 3 of the inventive microwavable container is preferably composed of two parts 4 and 5 which are connected with one another by hinge means 6, formed in a known manner. The hinge means can include one hinge part having a pin and another hinge part having an opening and turnable relative to the pin, to allow turning of the cover parts 4 and 5 relative to one another. The cover part 4 is provided with a plurality of throughgoing holes, while the cover part 5 is solid and has no holes. Either the cover part 4 or the cover part 5 can alternatingly be lifted for opening a corresponding portion of the main container part 2.

For cooking pasta, noodles, lasagna, rice, etc., the corresponding food product is placed on a bottom of the main container part 2. The cover 3 is placed on the main housing part 2. Corresponding liquid can be introduced into the container. The container is placed into a microwave oven, for cooking or heating up of the corresponding food product. Vapors escape through the throughgoing holes 7 of the cover part 4.

For steaming food products in the container in accordance with the present invention, for example vegetable, fish, potatoes, etc., the container is provided with at least one steam rack, for example a steam rack 8. The steam rack 8 has a substantially vertical wall 9 to be placed on a bottom of the main container part, and a substantially horizontal wall 10 provided with a plurality of throughgoing perforations 11. The bottom of a main container part 2 can be provided with an upwardly extending projection 12 for centering of the steam rack 8.

The container in accordance with the present invention can be also provided with another steam rack which is identified with reference numeral 13. The steam rack 13 is provided to be located higher in the container. It has a substantially vertical wall 14 which can be placed on a shoulder 15 provided in a peripheral wall of the main container wall 2 and a substantially horizontal wall 16 provided with a plurality of throughgoing perforations 17.

Products to be steamed in the inventive container can be placed on one of the racks 8 and 13, or on both racks simultaneously. Liquid placed in the container, during steaming evaporates and vapors pass through the corresponding throughgoing perforations provided in the steam racks, and then escapes through the throughgoing holes 7 in the cover part 4 of the cover.

The container for microwavable food in accordance with the present invention is provided with at least one handle, preferably with two handles identified with reference numerals 18. The handle is formed as substantially cylindrical element and has a cylindrical part 19. Each handle 18 is hollow, and preferably transparent, and configured as a measuring element for measuring a food product to be introduced into the container. For example for measuring a pasta, it is introduced into the interior of the handle 18 until it fills it, and therefore is precisely measured by the inner volume of the handle 18,to be then introduced into the container.

Figure 4:
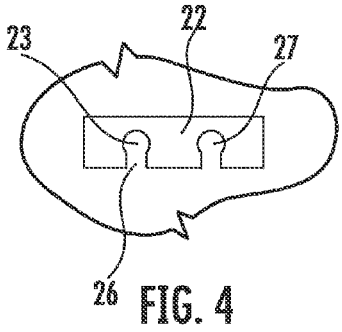
FIG. 4 is a view showing an attachment to a side wall of the container for microwavable food for supporting a handle.
Figure 5:
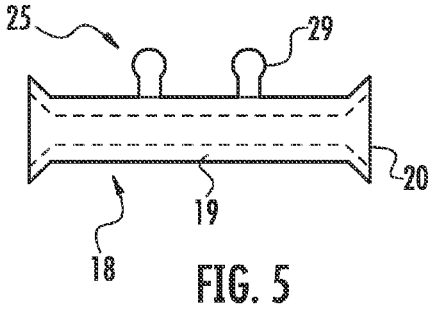
FIGS. 5 and 6 are a side view and an end view of one of the handles of the container for microwavable food in accordance with the present invention, which simultaneously is configured as a measuring element for measuring a food product to be introduced into the container.
Figure 6:
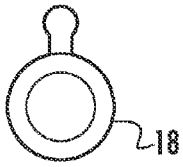
Figure 7:
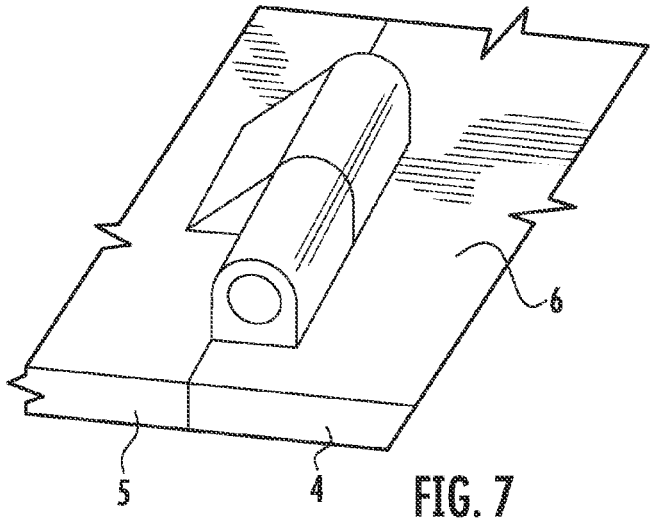
FIG. 7 is a perspective view of hinge means for hingedly connecting two parts of a cover of the container for microwavable food in accordance with the present invention.
Figure 8:
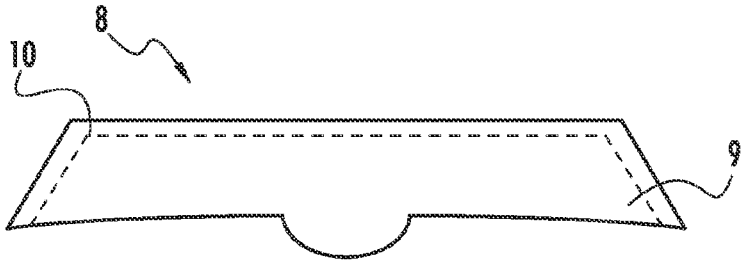
FIGS. 8 and 9 are a side view and a top of a bottom steaming rack of the container for microwavable food in accordance with the present invention.
Figure 9:
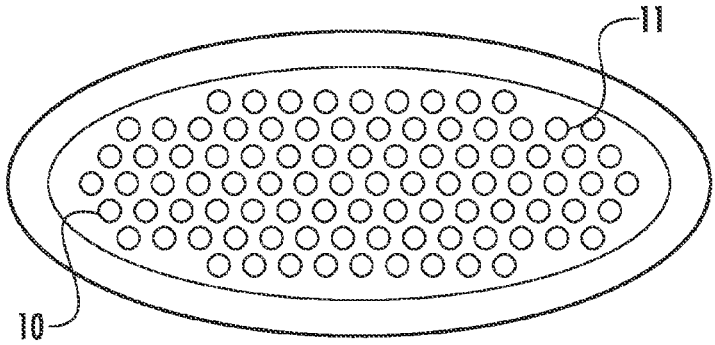
Figure 10:
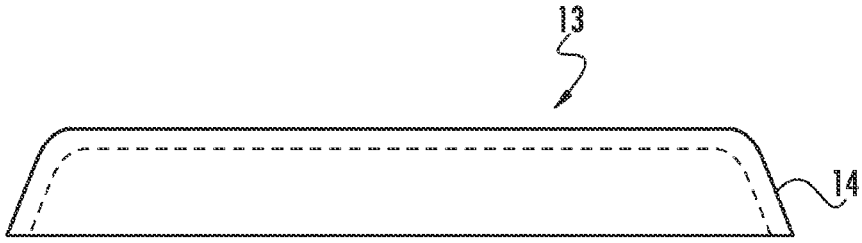
FIGS. 10 and 11 are a side view and a plan view of a top rack for steaming of the inventive container for microwavable food.
Figure 11:
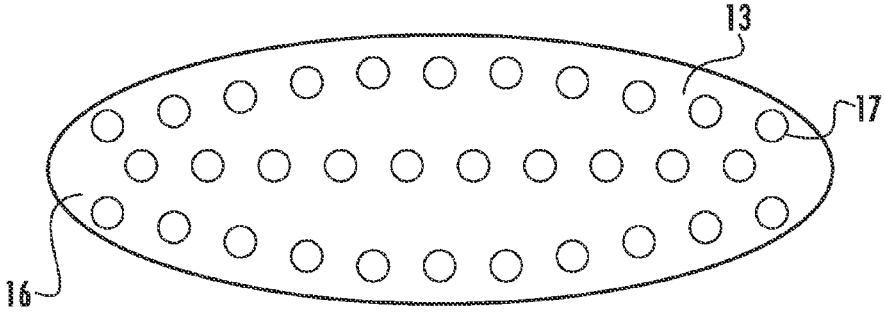

The handles are attached to the sides of the main container part 2. For this purpose the main container part is provided with projecting elements formed with at least one slot 23, and preferably with two slots, while each handle 18 is provided with a projection 25, preferably two projections which are insertable into the slots 23. As can be seen from FIGS. 4 and 5, each slot 23 is formed with an outwardly open narrow part 26 and a relatively wider inner part 27, while each projection 25 is provided with a narrow extension with a narrow thickening 29 so that the projection 25 can be introduced into and held in the opening 23, to hold the handles on the main container part.

As can be seen from FIG. 1, the upper part of the steam rack 13 can be provided a peripheral downwardly extending bend, while the peripheral part of the cover 3 is fitted on it, with an elastic action, to firmly hold the cover 3 on the upper rack 13. When the upper steam rack 13 is not used, the cover 3 is held directly on the main container part 2 which can also have a similar bend to provide an elastic holding action.

The cover 3 can be opened only partially. For example, for unloading the cooked product from the container and simultaneously allowing escape of steam, the cover part 5 can be lifted, while the cover part 4 can be held closed, so that the cooked product is removed through a left open part of the container, while the steam containers escaping through the openings 7 of the closed cover part 4.

Figure 12:
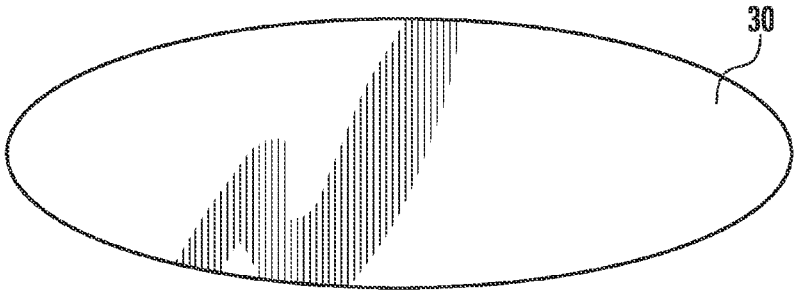
FIG. 12 is a plan view of an additional cover of the container for microwavable food in accordance with the present invention as a whole.
Figure 13:
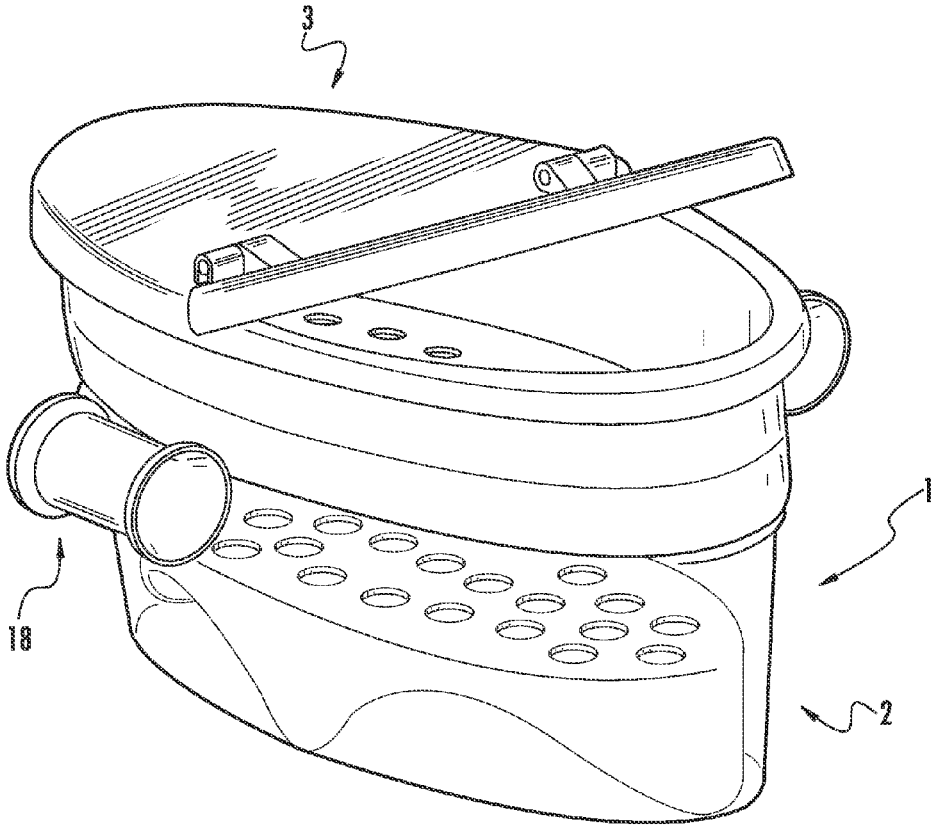
FIG. 13 is a perspective view of the inventive container for microwavable food.

Also, an additional solid cover 30 can be provided as shown in FIG. 12, which does not have openings and sealingly closes the container.

It will be understood that each of the elements described above, or two or more together, may also find a useful application in other types of constructions differing from the type described above.

While the invention has been illustrated and described as embodied in a container for microwavable food, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A container for microwavable food, comprising a main container part for accommodating a food product to be cooked and open from above; a cover covering said main container part from above; and at least one insert accommodated in said container part and provided with a plurality of perforations for placing a food product to be steamed on said insert, wherein said cover is composed of two cover parts, which are alternatingly openable, one of said cover parts being provided with throughgoing holes while the other of said cover parts being solid to allow simultaneously unloading of the food product when the other solid cover part is open and allowing steam to escape through the one cover part.

2. A container for microwavable food as defined in claim 1, wherein said two cover parts are provided with hinge means for hingedly connecting with one another.

3. A container for microwavable food, comprising a main container part for accommodating a food product to be cooked and open from above; a cover covering said main container part from above; and at least one insert accommodated in said container part and provided with a plurality of perforations for placing a food product to be steamed on said insert; and at least one handle which is removably attachable to said main container part, said at least one handle being hollow and configured as a measuring element for measuring a food product to be introduced into said container, wherein said at least one handle is substantially cylindrical and has a main cylindrical part, and at least one funnel provided at one axial end of said cylindrical part.

4. A container for microwavable food as defined in claim 3; and further comprising a second such handle configured as a measuring element, said handles being hollow and being arranged at opposite sides of said main container part.

5. A container for microwavable food as defined in claim 3, wherein said handle has a second funnel-shaped part provided on another second axial end of said cylindrical part.

* * * * *